US009302367B2

(12) United States Patent
Burge et al.

(10) Patent No.: US 9,302,367 B2
(45) Date of Patent: Apr. 5, 2016

(54) NON-NEWTONIAN LAP

(75) Inventors: James H. Burge, Tucson, AZ (US); Dae Wook Kim, Tucson, AZ (US)

(73) Assignee: Arizona Board of Regents on Behalf of the University of Arizona, Tucson, AZ (US)

( * ) Notice: Subject to any disclaimer, the term of this patent is extended or adjusted under 35 U.S.C. 154(b) by 893 days.

(21) Appl. No.: 13/210,800

(22) Filed: Aug. 16, 2011

(65) Prior Publication Data

US 2012/0040590 A1 Feb. 16, 2012

Related U.S. Application Data

(60) Provisional application No. 61/401,616, filed on Aug. 16, 2010.

(51) Int. Cl.
*B24B 37/11* (2012.01)
*B24B 37/24* (2012.01)

(52) U.S. Cl.
CPC ..... *B24B 37/11* (2013.01); *B24B 37/24* (2013.01)

(58) Field of Classification Search
CPC ..... B24B 29/00; B24B 37/14; B24B 37/24; B24B 37/30
USPC ..... 451/526, 529, 36, 490
See application file for complete search history.

(56) References Cited

U.S. PATENT DOCUMENTS 4,471,579 A 9/1984 Bovensiepen
4,598,502 A * 7/1986 Lombard ..... B24B 13/02 451/277
5,205,083 A * 4/1993 Pettibone ..... 451/42
5,885,147 A * 3/1999 Kreager et al. ..... 451/443
5,897,424 A 4/1999 Evans et al.
6,106,380 A * 8/2000 Jacobs et al. ..... 451/360
6,439,979 B1 * 8/2002 Beppu ..... B24B 37/12 451/285
6,527,632 B1 3/2003 Dooley et al.
6,610,798 B1 * 8/2003 Bleijenberg et al. ..... 526/88
6,776,688 B2 * 8/2004 Kim ..... B24B 1/005 15/102
6,875,090 B2 4/2005 Goulet et al.
2002/0151260 A1 * 10/2002 Crevasse ..... B24B 41/061 451/288
2003/0220061 A1 * 11/2003 Prasad ..... 451/526
2004/0229553 A1 * 11/2004 Bechtold et al. ..... 451/42
2004/0266320 A1 * 12/2004 Walch ..... 451/36
2005/0079812 A1 * 4/2005 Bechtold ..... B24B 13/06 451/504
2009/0093193 A1 * 4/2009 Bae ..... 451/8

OTHER PUBLICATIONS

NPL: Foresti, Roy, Jr. "Agitation of Non-Newtonian Liquids." Industrial and Engineering Chemistry 51.7 (Jul. 1959): 860-64. Web.*

* cited by examiner

*Primary Examiner* — Joseph J Hail
*Assistant Examiner* — Arman Milanian
(74) *Attorney, Agent, or Firm* — McDonnell Boehnen Hulbert & Berghoff LLP

(57) ABSTRACT

In a non-conventional lap tool, i.e., not a stiff tool nor a conformable tool, and related method for grinding/polishing a substrate surface, includes a rigid base plate and attached work surface to define a cavity containing a non-Newtonian fluid. The non-Newtonian fluid behaves as a solid when the work surface is subjected to high shear stress, i.e., rapid tool stroke, yet behaves like a liquid when the tool is moved around the substrate surface when the shear stress of the work surface is low. A diaphragm can be used to further define the cavity and to seal within the non-Newtonian fluid therein.

20 Claims, 3 Drawing Sheets

NON-NEWTONIAN LAP

CROSS REFERENCE TO RELATED APPLICATIONS

This application is a non-provisional of U.S. Provisional Application No. 61/401,616 for Non-Newtonian Lap, filed Aug. 16, 2010, the entire contents of which are incorporated herein by reference.

FIELD OF THE INVENTION

This invention relates to a lapping device for use in grinding, lapping and/or polishing substrates, such as semi-conductor wafers, optical lenses, mirrors, and computer hard disks, as well as methods of making same and methods of using same. In particular, the present invention relates to an apparatus and method for finishing contoured optical surfaces in accordance with particular prescriptions, and more directly, to such apparatus and methods incorporating work surfaces which are selectively conformable to a broad range of optical surface curvatures for performing work operations on these surfaces.

BACKGROUND

A wide variety of laps are used in the polishing field to achieve smooth surfaces on a variety of substrates. When polishing, lapping or grinding, the surface of the lap is brought into contact with the surface of the substrate to be treated and relative movement is induced with respect to the substrate and the lap, resulting in smoothing of the substrate surface. A polishing pad or media such as a particulate abrasive or an abrasive slurry is usually provided at the interface between the lap surface and the substrate to facilitate polishing. Relative movement can be induced manually or mechanically. Examples of polishing laps are described In U.S. Pat. Nos. 4,471,579; 6,527,632; 6,875,090; and 5,897,424.

On a large scale, the lap surface has a shape corresponding to the desired general shape of the substrate to be treated. For example, the lap surface can be, in general, flat or, if the substrate is to have a concave surface, then the lap will have a corresponding convex surface. On a smaller scale, the lap surface, particularly the polishing pad, is textured. Texturing facilitates dispersion of the polishing media over the lap surface as well as provides areas that can act as reservoirs for the polishing medium and for the material removed from the surface of the substrate being treated. The lap surface can be further provided with embedded abrasive particles to facilitate polishing.

Laps typically comprise two types: stiff or conformable. Examples of a stiff lap tool include, stressed lap, pitch tool, aluminum plate tool, and tile tool. These stiff laps are often made of a hard material, such as cast iron or ceramic. These materials are accurately machined to achieve the desired overall shape, as well as the smaller scale texturing of the lap surface. Large stiff tools are relative easy and inexpensive to manufacture and can provide smoothing effects (hitting highs on a rough surface), so that the high spatial frequency errors on the work piece or substrate can be easily removed. During the polishing, lapping or grinding, the surface of the lap must be monitored to determine whether any changes occur. Changes in the surface conditions of the lap can induce imperfections in the substrate surface being polished. As a result, if such changes occur, the lap must be replaced. The tool maintenance (or use) is difficult, because the contacting surface shape of the tool needs to be maintained (or fitted to the work piece before each use) to avoid misfits. This also gives limits to fabricating aspheric (or freeform) work pieces, because the local work piece surface shape keeps changing as a function of tool location on the work piece. Because the tool does not fit to the work piece, it is hard to predict the material removal using the tool. Also, if the lap surface contains embedded abrasive particles, the abrasive size can change during the process, thereby requiring tedious lap cleaning and reconditioning procedures. Although good surface accuracy can generally be obtained using such hard laps, one is not often able to achieve the best surface finish. A further disadvantage associated with laps made of metal materials, such as cast iron, is that such laps may not possess adequate chemical resistance to the polishing media being employed which can be highly acidic, highly alkaline or in other ways reactive with the metal itself.

To eliminate some of the above-mentioned problems with stiff laps, it is known to use polishing cloths in conjunction with hard laps. In such cases, the hard laps are shaped as required to provide both the desired overall shape and texturing and then the lap surface is faced with a pad made of various materials, such as felt, velveteen or synthetic fabrics. While such laps can provide good surface finish when used with appropriate polishing media, there is a disadvantageous loss of dimensional control with respect to the shape of the substrate being treated.

Laps are frequently employed in methods for finishing the prescription surface of an ophthalmic lens. A thin finishing pad is attached to the contoured surface of the lap, typically by adhesive, and an abrasive material is either directed onto the pad in the form of a slurry or is incorporated into the pad itself. Since the finishing pad in conventional finishing operations is relatively thin and must take its shape from the lap, the lap in turn must be ground with contours that essentially conform to the prescription or curvatures of the lens being finished. As a consequence, finishing laboratories must stock a large number of hard or rigid laps corresponding to the full range of prescriptions that are commonly required. As such, a significant inventory of laps is needed.

As an alternative, the lens blank from which the eyeglass lens is formed can be coarsely ground to the desired prescription, and a conformable lap can be used as the tool for the finishing operation. A conformable lap in general has a work surface that is adapted to conform to the curvature of the contoured surface ground on the lens blank. These laps use materials such as liquid, air, foam, and like materials such that the contacting surface of the lap conforms to shape of the surface of the work piece or substrate. Thus, during a finishing operation, which may employ a polishing pad with a slurry, the coarseness of the contoured surface is removed but the general curvatures defined by the prescription are preserved. Other advantages to a conformable lap is that one tool can be used for many different work pieces, because they fit to all work piece surface. It can be used to fabricate aspheric (or freeform) work pieces without worrying about the misfits. Because the tool always fits to the work piece, material removal is very predictable and stable. However, there are a number of disadvantages with conformable laps, namely, the tool is expensive because it is necessary to control the liquid-like (or air-like) materials. As such, making a large tool (>30 cm diameter tool) is difficult and expensive. It is also very hard to achieve smoothing effects because when the tool material is too conformable (e.g., water), the pressure under the tool is not preferably high on the peak areas of the work piece as the tool moves around.

What is needed is a lap tool that takes the advantages from both stiff and conformable tools, such that when the tool stroke (i.e., tool motion) is fast, the lap acts like a stiff tool locally, yet when it moves around on the work piece (at relatively slow speed), the lap acts like a conformable tool. The invention described herein achieves this need and solves the above-mentioned problems associated with both conventional stiff and conformable laps.

SUMMARY

The present invention is neither a stiff lapping tool nor a conformable tool. It is a hybrid lap tool containing a non-Newtonian fluid that behaves like both a solid and a liquid depending on the lapping conditions. When the tool stroke (i.e., tool motion) is fast, the lap acts like a stiff tool locally, yet when it moves around on the work piece (at relatively slow speed), the lap acts like a conformable tool.

More specifically, the present invention is directed to a lap for grinding and/or polishing substrates comprising a rigid back plate, a work surface extending adjacent to the back plate for contacting a selected surface of a substrate having a non-smooth surface, where the work surface comprises a material that can conform to the selected surface and a non-Newtonian fluid having an apparent viscosity that forms a layer extending between the rigid back plate and the work surface, where the apparent viscosity changes as a function of shear stress applied to the work surface. The non-Newtonian fluid permits movement of the work surface relative to the back plate to conform to the selected surface of the substrate.

An inexpensive, non-toxic example of a non-Newtonian fluid is a suspension of starch (flour) in water, sometimes called oobleck (uncooked imitation custard, being a suspension of primarily corn flour, has the same properties). Another non-Newtonian fluid is SILLY PUTTY®, which is an example of a polymer based suspension. The application of force to some types of non-Newtonian fluids—for example by stabbing the surface with a finger, or rapidly inverting the container holding it—leads to the fluid behaving like a solid, rather than a liquid. Such non-Newtonian fluid is referred to as having a "shear thickening" property. More gentle treatment, such as slowly inserting a spoon, will leave it in its liquid state. Trying to jerk the spoon back out again, however, will trigger the return of the temporary solid state. Fluids exhibiting such properties are referred to as visco-elastic non-Newtonian fluids. In contrast, most low molecular weight substances such as organic and inorganic liquids, solutions of low molecular weight inorganic salts, molten metals and salts, and gases exhibit Newtonian flow characteristics, i.e., at constant temperature and pressure, in simple shear, the shear stress is proportional to the rate of shear and the constant of proportionality is dynamic viscosity. Such fluids are classically known as the Newtonian fluids. Non-Newtonian fluids, especially of multi-phase nature (foams, emulsions, dispersions and suspensions, slurries, for instance) and polymeric melts and solutions (both natural and man-made) do not conform to the Newtonian postulate of the linear relationship between shear stress and shear rate in simple shear. Likewise, the apparent viscosity, defined as shear stress/shear rate, is not constant and is a function of shear stress or shear rate.

A preferred non-Newtonian fluid is visco-elastic, most preferably selected from the group consisting of a polymer based suspension and a starch based suspension. This class of non-Newtonian fluid is similar to pseudoplastic systems in that they show no yield stress, but their apparent viscosity increases with the increasing shear rate. One explanation of this behavior is as follows: At rest, the voidage of the suspension is minimum and the liquid present in the sample is sufficient to fill the voids completely. At low shearing levels, the liquid lubricates the motion of each particle past another thereby minimizing solid-solid friction. Consequently, the resulting stresses are small. At high shear rates, however, the mixture expands (dilates) slightly (similar to that seen in sand dunes) so that the available liquid is no longer sufficient to fill the increased void space and to prevent direct solid-solid contacts (and friction). This leads to the development of much larger shear stresses than that seen in a pre-dilated sample at low shear rates. This mechanism causes the apparent viscosity to rise rapidly with the increasing rate of shear. One preferred shear thickening or visco-elastic non-Newtonian fluid preferred in this invention is a silicone polymer, most preferably one that is sold under the brand name SILLY PUTTY®. This particular non-Newtonian fluid is noted for its unusual characteristics: it bounces, but breaks when given a sharp blow; it can also flow like a liquid and will form a puddle given enough time. It contains thixotropic agents added to reduce the flow and enable the putty to hold its shape. One component known to be responsible for the unusual flow characteristics is polydimethylsiloxane (PDMS), a visco-elastic liquid that causes the material to act as a viscous liquid over a long time period, but also as an elastic solid over a short time period. Because its apparent viscosity increases directly with respect to the amount of force applied, SILLY PUTTY® can be characterized as a dilatant or shear thickening non-Newtonian fluid.

In a preferred embodiment, the lap of this invention has a work surface comprising a diaphragm that completely encloses the non-Newtonian fluid. The amount of non-Newtonian fluid contained within a cavity formed and defined by the work surface of the lap depends of course on the size of the lap tool itself. Preferably, the thickness of the non-Newtonian fluid, measured from the surface of the base plate to the inner surface of work surface is from about 0.5 cm to about 5 cm, preferably around 2 cm in thickness. In a preferred embodiment the work surface includes a molded diaphragm, most preferably a rolling diaphragm manufactured and sold by Bellofram Corporation. These types of diaphragm are typically formed in the shape of a truncated cone, or top hat, which allows for a smooth, low friction rolling action when used. In other words, these diaphragms provide a good means to contain the non-Newtonian fluid without causing problematic high local pressure around the perimeter of the contact area.

In one preferred design the diaphragm has an outer flange that can be clamped to the surface of the base plate to form a sealed inner chamber to contain the non-Newtonian fluid, preventing blow-by leakage and pressure loss. Such diaphragms can operate under pressures up to 3,000 psi and at temperatures from −120° F. to +600° F. They can also be fabricated to be highly resistant to oil, ozone, acids, alkalies, steam and other corrosive fluid. The diaphragm can be manufactured from materials that include elastomers, including neoprene, fluorocarbon, fluorosilicone, silicone, epichlorohydrin, nitrile, EPDM, HNBR, GFLT, and AFLAS. Reinforcing fabrics can be laminated or composited with the diaphragm, including, polyester, nylon, and knit fabrics, including polyester and nomex to increase the strength and durability of the diaphragm.

The work surface the lap this invention can also have a polishing pad attached, preferably attached directly to the diaphragm, when one is used. In some case the polishing pad by itself can form the cavity that contains the non-Newtonian fluid or the pad can be integrated into the surface of the diaphragm when the diaphragm is manufactured. A preferred material of construction for the polishing pad is polyurethane, however, other types of polishing clothes known to the art can be used, for example, 3M™ Trizact™ abrasive. The polishing pad is preferably removably attached to the diaphragm and is easily replaceable without requiring special tools to remove it. Additionally, depending on the size of the work surface of the lap, the polishing pad may comprise multiple individual pieces (e.g., tiles), each separately attached, and forming a large polishing/grinding surface. Attaching a single piece (or multiple pieces) of the polishing pad is achieved through the use of an appropriate adhesive, for example, 3M™ Super Adhesive Spray. Preferably, the pad(s) maybe the "peel and stick" type where adhesive is already applied to one side of the pad and is covered with a paper backing that is peeled off prior to attaching the pad to the diaphragm. The thickness of the polishing pad is not critical to the invention, provided that it is not of such a thickness that it masks the performance of the non-Newtonian fluid. Preferably, the preferred thickness of the polishing pad is in the range of from about 0.5 mm to about 2 mm. Alternatively, the diaphragm and polishing pad are unitary in construction comprising a composite or laminate material where the polishing pad surface is oriented outwardly towards the substrate to be polished to provide direct contact to the substrate or work piece. In some cases, it may be necessary or desirable to insert a layer of stiff material between the polishing pad and the diaphragm outer (or inner) surface. Such stiff materials include thin plastic sheets and have a thickness in the range of from about 0.1 mm to about 1 mm.

In those embodiments where a diaphragm is used, it may be held in place or attached to the base plate, preferably using a retainer to secure the work surface directly to the back plate. One or more fasteners can be used that engage the base plate and work surface to form a seal to retain the non-Newtonian fluid within a cavity defined by the work surface. Conventional fasteners, such as bolts or screws or other clamping means, can be used. Preferably, the engaging surface of base plate where the retained is attached is flat and constructed of aluminum, however, other stiff or rigid materials, such as, stainless steel, plastic, ceramic, and mixtures thereof can be used to manufacture the back plate.

The present invention also includes a method of manufacturing a lap containing a non-Newtonian fluid comprising machining or otherwise providing a rigid back plate that is configured to be removably attachable to a lap mount that is part of, or connectable to, a lapping machine; placing an amount of non-Newtonian fluid having an apparent viscosity to form a layer extending between the rigid back plate and a work surface work surface, where the apparent viscosity changes as a function of shear stress applied to the work surface. The method can also include forming a cavity between the topside of the rigid back plate and work surface that will hold the non-Newtonian fluid and permit movement of the work surface relative to the back plate to conform to the selected surface of the substrate that is to be ground and/or polished. The cavity can be formed using a diaphragm that is placed over or filled with the non-Newtonian fluid and secured to the back plate by installing a retainer that clamps, compresses and/or seals the diaphragm releasably to the back plate, preferably using a plurality of connectors, such as, screws, bolts, pins, rivets, clamps, or the like connectors. If the diaphragm does not have an abrasive outer surface, then a separate polishing pad or tiles of polishing pads are glued or otherwise adhered to the other surface of the diaphragm.

In yet another embodiment of the invention there is a method of grinding and/or polishing at least one surface of a substrate using at least one lap device as described above. The method can include installing the lap tool into a commercial CCPM (Computer Controlled Polishing Machine) and applying a shear stress to the work surface during the grinding and/or polishing using an applied pressure in the range from about 0.1 to 1.0 psi. The method can also include the use of a polishing compound, which is applied to the work surface prior to the grinding/polishing. Any polishing compound known to the art will work with the lap of this invention, however, a preferred polishing compound includes those selected from the group consisting of rhodite, opaline, aluminum oxide, and mixtures thereof. Preferably, the lap tool of our invention is operated at a speed of from about 5,000 to about 1,500 mm/min relative to the substrate being polished/ground and where a conditioning run is performed prior to the grinding/polishing. The conditioning run is preferred because in some polishing procedures it is desirable to start with a smoother polishing pad that exhibits a more stable speed of material removal from the substrate (i.e., a stable Preston C value) as compared to a new, non-conditioned polishing pad. A higher Preston C value means faster polishing process, which can significantly reduce the overall cost of the polishing/grinding operation. Using the non-Newtonian lap of this invention results in stable Preston C values, especially when these laps are used on optical surfaces having highly aspheric surfaces. This is because the non-Newtonian lap makes a very uniform and stable contact with the substrate surface.

The lap tool of this invention can be used to grind and/or polish substrates selected from the group consisting of semiconductor wafers, mirrors or other reflective surfaces, optical lenses, car bodies, and computer hard disks.

Benefits achieve using the non-Newtonian fluid filed lap tool of this invention include ease of manufacture of large tools having diameters greater than 10 cm in diameter and at low cost. The lap provides medium smoothing effects (hitting highs only on a rough surface), so that the high spatial frequency errors on the work piece can be removed. Also, one tool can be used for many different work pieces or substrates, because the work surface fits to any work piece surface. These non-Newtonian laps can be used to fabricate aspheric (or freeform) work pieces without worrying about misfits. And, because the tool always fits to the work piece, the material removal using the tool is very predictable and stable.

Other advantages of the present invention will become apparent in view of the following detailed description and accompanying drawings.

DETAILED DESCRIPTION

Figure 1:
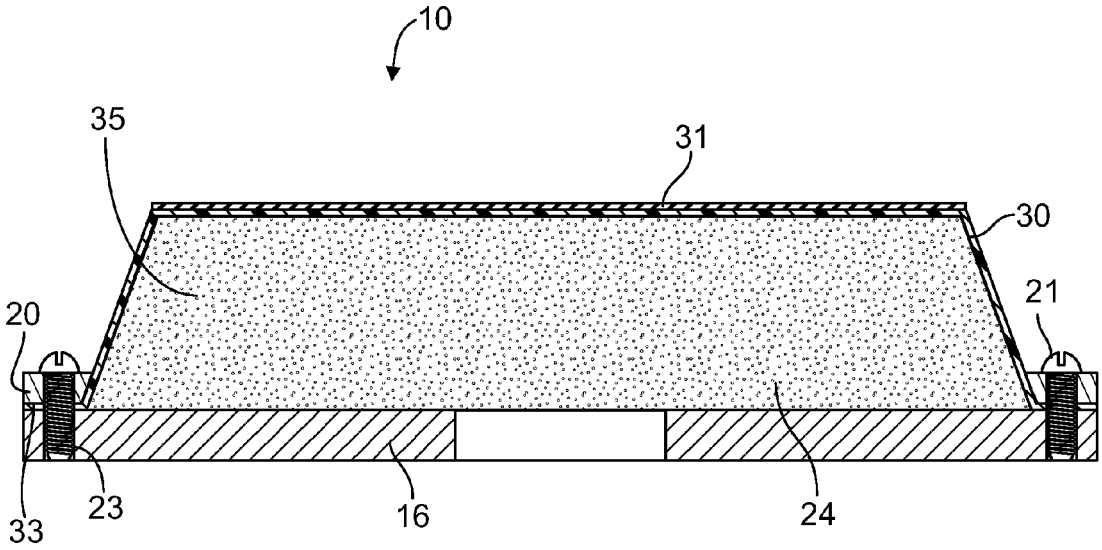
FIG. 1 is a cross-sectional view of the lap of this invention.
Figure 2:
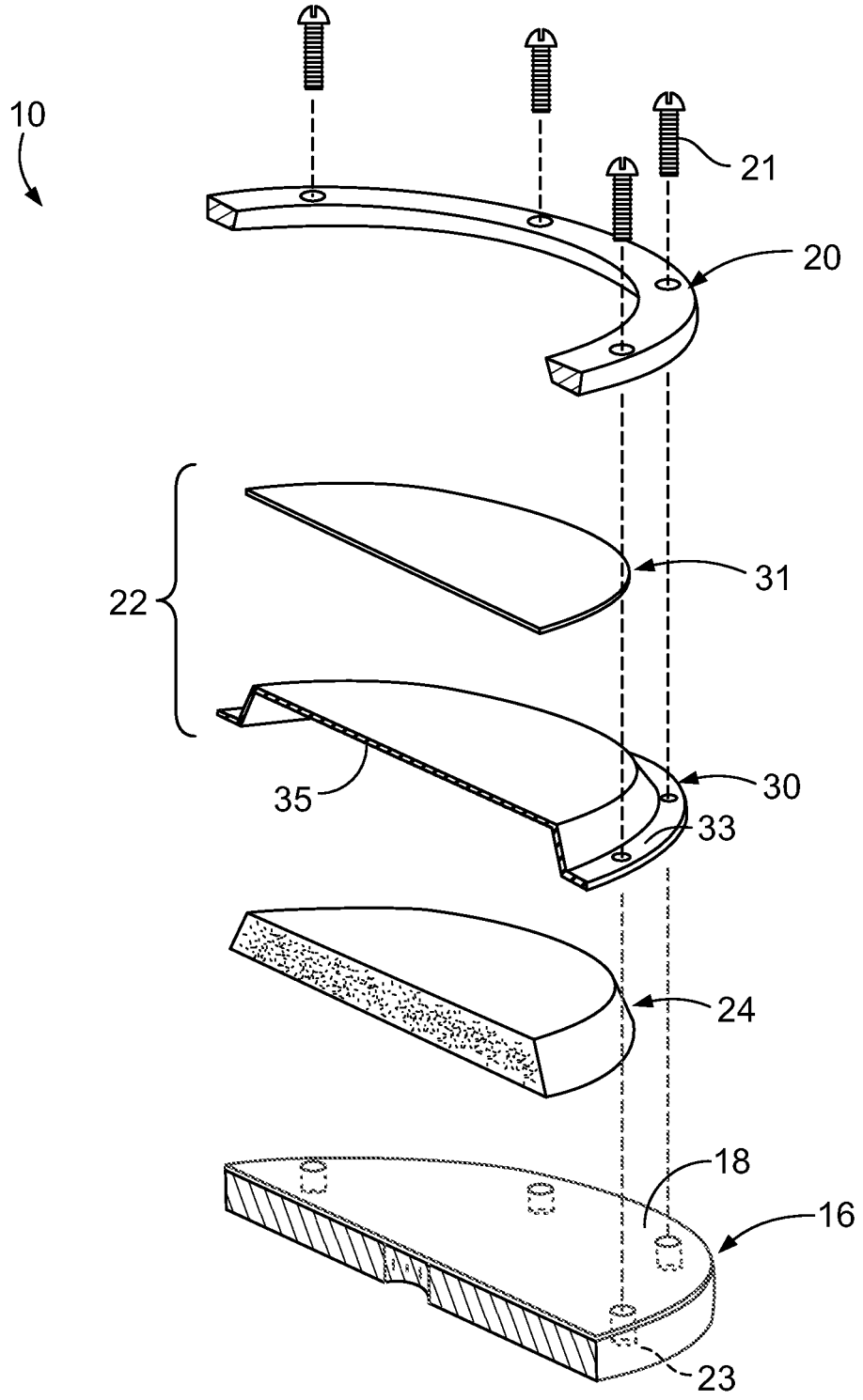
FIG. 2 is an exploded, partial schematic illustration of the lap of the present invention.

In FIG. 1, a cross-sectional view of a lap assembly embodying one possible configuration of the present invention is indicated generally by the reference numeral 10. The lap assembly 10 can be connected to a lap mount 14 (see FIG. 3) for fixedly securing the lap to lapping machine 5 during set up and finishing operations. FIGS. 1 and 2 show the non-Newtonian lap 10 comprising a base plate 16 defining a rigid base surface 18, and a mounting retainer or flange 20, including a plurality of fasteners 21 that engage corresponding holes 23 in base plate 16. A work surface 22 is superimposed over the rigid base surface 18, and comprises a finishing/polishing pad 31 mounted to a molded diaphragm 30. A non-Newtonian fluid 24 forms a layer extending between the work surface 22 and rigid base surface 18.

As described earlier, in its non-solid form the non-Newtonian substance 24 permits movement of the work surface 22 relative to the base surface 18 to conform to the curvature of a selected substrate surface, and when the tool stroke (i.e., tool motion) is fast, the non-Newtonian fluid 24 acts like a solid that fixes the work surface 22 in a position conforming to the curvature of the selected optical surface and retains the conforming position until it moves around on the work piece (at relatively slow speed), where the non-Newtonian fluid again behaves more like a fluid and the lap acts like a conformable tool. The base/back plate 18 defines a flat surface to allow the flange 33 of diaphragm 30 to be clamped and sealed by retainer 20 through the use of fasteners 21 engaging preferably threaded holes 23. Diaphragm 30 is in the shape of a truncated cone and forms an interior cavity 35 that is filled with the non-Newtonian fluid 24, which as shown conforms to the shape of the cavity 35. The retainer 20 clamping flange 33 seals the non-Newtonian fluid 24 within cavity 35. Importantly, the non-Newtonian fluid does not include any thermoplastic materials that are readily changeable between solid and non-solid forms by the application of, for example, heat, radiation, or chemicals. As such, the lap of this invention is not classified as a conformable lap, which includes such thermoplastic materials. The lap 10 of this invention does not require the application/removal of heat or chemicals to cause the non-Newtonian fluid 24 to change from a fluid to a solid and then back again. Varying the speed of the tool stroke imparts changing shear stress at the work surface and this results in the changing properties exhibited by the non-Newtonian fluid.

Figure 3:
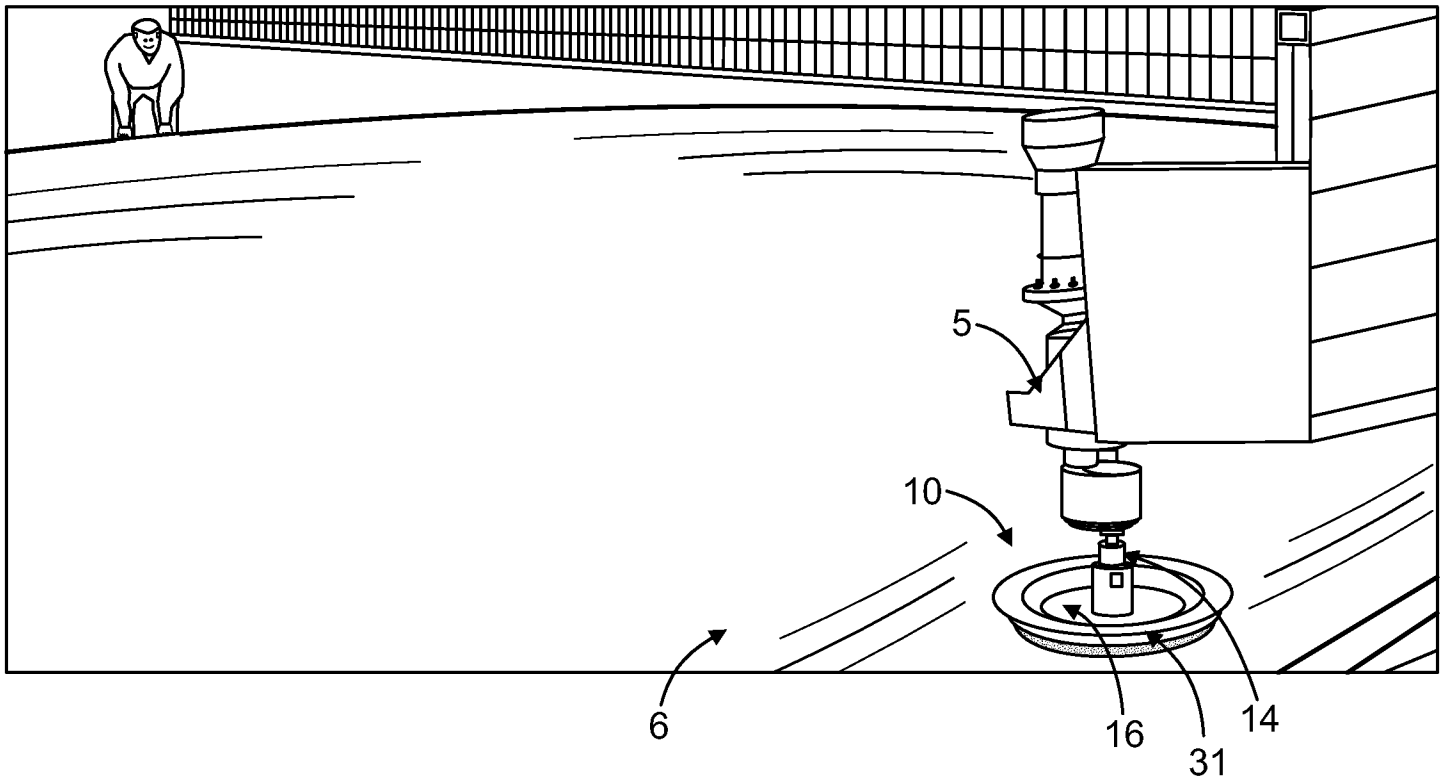
FIG. 3 is a perspective view of the lap of this invention attached to a lapping machine in contact with a large observatory mirror as the substrate.

During set up, the conformable lap 10 is fixedly secured to the lap mount 14, as shown in FIG. 3. Any type of connection known to those skilled in the art can be used. FIG. 3 shows the lap 10 detachably mounted to lap mount 14, which is part of lapping machine 5. Lap 10 is polishing substrate 6 shown as an observatory mirror.

As shown in FIG. 1, a finishing pad 31 is superimposed on, and attached to the molded diaphragm 30 to further define the work surface 22. The finishing pad 31 may be formed in accordance with any of numerous known finishing pads that are commercially available for fining and/or polishing optical surfaces. Accordingly, the finishing pad 31 may have an abrasive material, such as a silicone carbide grit, bonded or otherwise integrated into the pad to form the work surface for fining the selected optical surface. An exemplary finishing pad is provided in the form of a slotted disk. For polishing, on the other hand, the pad 31 may be in the form of a fibrous finishing pad without abrasives (e.g., a non-woven fabric, such as felt) which may be used with a slurry, if necessary, introduced at the interface of the optical and work surfaces.

The finishing pad or like work surface 31 is superimposed on, and attached to the diaphragm 30 by any of numerous means for attaching or joining known to those of ordinary skill in the pertinent art. Preferably, the finishing pad is attached by an adhesive, or a double-sided fastening tape, which fixedly secures the finishing pad in place and prevents any relative movement between the pad and underlying outer surface of the diaphragm during finishing operations. Preferably, the lap 10 includes means for interchangeably attaching the finishing pad or like member 31. For example, the underside of the finishing pad 31 may include a double-sided adhesive or other fastening tape (e.g., Velcro™), or other means for fastening or joining and permitting the finishing pad to be attached to, and detached from the underlying diaphragm without tools. As an alternative to a separate finishing pad 31, the outer surface of the diaphragm may be configured to incorporate a polishing surface. However, the interchangeable finishing pads 31 are currently preferred.

As will be recognized by those of ordinary skill in the pertinent art, numerous changes and modifications may be made to the above-described invention without departing from its scope as defined in the appended claims. Accordingly, this detailed description of preferred embodiments is to be taken in an illustrative, as opposed to a limiting sense.

The invention claimed is:

1. A lap for grinding and/or polishing substrates, comprising:

a rigid back plate;

a work surface extending adjacent to the back plate for contacting a substrate surface, where the work surface comprises a polishing pad attached to a diaphragm, where the diaphragm comprises an elastomer truncated cone that defines a truncated cone shaped cavity extending between the rigid back plate and the work surface; and a non-Newtonian fluid including polydimethylsiloxane (PDMS) sealed inside the truncated cone shaped cavity, where the non-Newtonian fluid retains the work surface in a fixed position locally relative to the back plate in response to a rotational tool stroke motion of the work surface while simultaneously permitting movement of the work surface relative to the back plate to conform to the substrate surface in response to a movement of the work surface along the substrate surface.

2. The lap of claim 1 where the non-Newtonian fluid comprises a fluid that exhibits shear thickening behavior.

3. The lap of claim 1 where the diaphragm is a molded diaphragm.

4. The lap of claim 3 where the molded diaphragm is a rolling diaphragm.

5. The lap of claim 1 where the polishing pad comprises polyurethane.

6. The lap of claim 1 where the polishing pad and diaphragm are formed as a laminated composite.

7. The lap of claim 1 where the polishing pad is removably attached to the diaphragm and is replaceable.

8. The lap of claim 1 further comprising a retainer to secure the work surface to the back plate.

9. The lap of claim 8 where the retainer comprises one or more fasteners that engage the back plate and the work surface to seal the non-Newtonian fluid within the truncated cone shaped cavity.

10. The lap of claim 1 where the rigid back plate is flat.

11. The lap of claim 1 where the substrate is selected from the group consisting of semi-conductor wafers, optical lenses, and computer hard disks.

12. A method comprising, grinding and/or polishing a substrate surface using at least one lap device, wherein the at least one lap device comprises:

a rigid back plate;

a work surface extending adjacent to the back plate for contacting the substrate surface, where the work surface comprises a polishing pad attached to a diaphragm, where the diaphragm comprises an elastomer truncated cone that defines a truncated cone shaped cavity extending between the rigid back plate and the work surface; and a non-Newtonian fluid including polydimethylsiloxane (PDMS) sealed inside the truncated cone shaped cavity;

where the grinding and/or polishing comprises simultaneously (i) moving the work surface in a rotational tool stroke motion such that a first shear stress rate is applied to the work surface, where the non-Newtonian fluid retains the work surface in a fixed position locally relative to the back plate in response to the first shear stress rate, and (ii) moving the work surface along the substrate surface such that a second shear stress rate is applied to the work surface, where the non-Newtonian fluid permits movement of the work surface relative to the back plate to conform to the substrate surface in response to the second shear stress rate.

13. The method according to claim 12, wherein a pressure is applied to the lap tool in the range from about 0.1 to 1.0 psi.

14. The method according to claim 12, wherein a polishing compound is applied to the work surface prior to the grinding/polishing.

15. The method of claim 12 where the movement of the work surface relative to the back plate is performed at a speed of from about 5,000 to about 1,500 mm/min relative to the substrate.

16. The method according to claim 12, wherein a conditioning run is performed prior to the grinding/polishing.

17. The lap of claim 1 where the diaphragm is a truncated cone.

18. The lap of claim 1 where a distance between the back plate and the work surface is between about 0.5 cm and about 5 cm.

19. The lap of claim 1 where the work surface is circular, and where a diameter of the work surface is greater than about 10 cm.

20. The method of claim 12 where the work surface is circular, and where a diameter of the work surface is greater than about 10 cm.

* * * * *